US010431403B2

(12) United States Patent
Tanoue et al.

(10) Patent No.: US 10,431,403 B2
(45) Date of Patent: Oct. 1, 2019

(54) REACTIVE FORCE GENERATION DEVICE

(71) Applicant: YAMAHA CORPORATION, Hamamatsu-shi (JP)

(72) Inventors: Michiko Tanoue, Hamamatsu (JP); Ichiro Osuga, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 1 day.

(21) Appl. No.: 15/928,140

(22) Filed: Mar. 22, 2018

(65) Prior Publication Data

US 2018/0286605 A1 Oct. 4, 2018

(30) Foreign Application Priority Data

Apr. 4, 2017 (JP) ..... 2017-074723

(51) Int. Cl.

| | |
|---|---|
| ***H01H 13/14*** | (2006.01) |
| ***G10H 1/00*** | (2006.01) |
| ***G10H 1/34*** | (2006.01) |
| ***H01H 13/52*** | (2006.01) |
| *H01H 13/70* | (2006.01) |

(52) U.S. Cl.

CPC ..... *H01H 13/14* (2013.01); *G10H 1/0008* (2013.01); *G10H 1/344* (2013.01); *G10H 1/346* (2013.01); *H01H 13/52* (2013.01); *G10H 2220/275* (2013.01); *H01H 13/70* (2013.01); *H01H 2205/002* (2013.01); *H01H 2217/01* (2013.01); *H01H 2221/044* (2013.01); *H01H 2227/022* (2013.01); *H01H 2227/028* (2013.01); *H01H 2231/018* (2013.01)

(58) Field of Classification Search

CPC ..... H01H 13/14; H01H 13/70; G10H 1/0008; G10H 1/344; G10H 1/346

USPC ..... 200/5 A

See application file for complete search history.

(56) References Cited

U.S. PATENT DOCUMENTS

| | | | | |
|---|---|---|---|---|
| 7,256,359 | B2 | 8/2007 | Nishida | |
| 9,269,336 | B2 | 2/2016 | Osuga et al. | |
| 2015/0090104 | A1* | 4/2015 | Osuga | G10H 1/32 84/744 |

(Continued)

FOREIGN PATENT DOCUMENTS

| | | | |
|---|---|---|---|
| JP | 2007025576 | A | 2/2007 |
| JP | 2015068967 | A | 4/2015 |

*Primary Examiner* — Edwin A. Leon
*Assistant Examiner* — Iman Malakooti
(74) *Attorney, Agent, or Firm* — Rossi, Kimms & McDowell LLP

(57) ABSTRACT

A to-be-depressed member includes an elastic dome. A sectional shape of the dome orthogonal to an axis line (X2) of the dome is line-symmetric about a symmetry axis (Ax). The dome has a three-dimensional shape that is symmetric with respect to a virtual plane (Sx) containing the symmetry axis and the axis line. During a swinging movement responsive to a depressing operation, an opposed surface of an opposed member relatively approaches and contacts a distal end of the dome to deform the dome so as to generate a reactive force. As for an angle defined between the axis line of the dome and a normal line (X1) of the opposed surface, the angle (θ0) in an initial state falls in a range from a first angle variation amount from the initial state to a first-contact state to a second angle variation amount from the initial state to a depression-completed state.

14 Claims, 5 Drawing Sheets

(56) References Cited

U.S. PATENT DOCUMENTS

2015/0220105 A1* 8/2015 Harimoto ..... G05G 5/03
200/239

* cited by examiner

REACTIVE FORCE GENERATION DEVICE

BACKGROUND

The present invention relates generally to a reactive force generation device which generates a reactive force by being depressed to elastically deform in response to an operation of a manual operator that is operable with a hand, foot or other body part of a user (or human operator).

Heretofore, there have been known reactive force generation devices which generate a reactive force by being depressed to elastically deform in response to a user's operation of a manual operator. For example, in the field of electronic keyboard musical instruments, a musical instrument has been known which includes, inside an elastic protrusion protruding from a base plate surface, a dome section protruding toward the base plate surface and a switch that elastically deforms by being depressed by a member, such as a key (see, for example, Japanese Patent Application Laid-open Publication No. 2007-25576 and U.S. Pat. No. 7,256,359 corresponding to the Japanese Patent Application Laid-open Publication No. 2007-25576). In this type of musical instrument, a movable contact is provided at the distal end of the dome section, while a fixed contact is provided on the base plate so that a sensor is turned on by the distal end of the dome section contacting the base plate. A reactive force acting substantially against the key is generated by the dome section and the like elastically deforming in response to depression of the key.

Also known in the art is a reactive force generation device which employs, mainly for the purpose of generating a reactive force, an elastic member included in such a dome section (see, for example, Japanese Patent Application Laid-open Publication No. 2015-68967 and U.S. Pat. No. 9,269,336 corresponding to the No. 2015-68967 publication). In the reactive force generation device disclosed in this patent literature, by a depressing force being applied to the dome section (reactive force generation member) in an axial direction of the dome section, the elastic member of the dome section elastically deforms to generate a reactive force to the applied depressing force. The reactive force thus generated increases as an amount of the elastic deformation increases in response to an increase of the applied depressing force, but, after the generated reactive force reaches its peak, the elastic member of the dome section buckles (i.e., bucklingly deforms) so that the reactive force suddenly decreases. Further, in this known reactive force generation device, the dome section (reactive force generation member) and a depressing section for depressing the doe section are constructed in such a manner that an axis line of the dome section (reactive force generation member) exists within an angle range between a normal line of the depressing surface of the depressing section relative to the dome section at a time point at a time point when the depressing section starts contacting the dome section and a normal line of the depressing surface of the depressing section relative to the dome section at a time point when the depressing section finishes depressing the dome section.

However, if an inclination of the axis line of the dome section relative to a normal line of the base plate surface becomes too great when the distal end of the dome section starts contacting (landing on) an opposed surface, such as the base plate surface, the landing action tends to become unstable. Consequently, an intensity and generation timing of the reactive force would become unstable, and durability of the reactive force generation device too would deteriorate. Further, if depression of the key is detected by electric or electronic contacts provided on respective contacting portions of the opposed surface and the dome section, behavior of the electrical or electronic contacts tend to become unstable, resulting in unwanted chattering so that generation of a sound (tone) may be performed inappropriately. Furthermore, the above-discussed conventionally-known reactive force generation devices are constructed only in consideration of a single-pivot-axis design where a movement (stroke movement) for applying a depressing force to the dome section (reactive force generation member) is made always about a fixed pivot axis; namely, in these conventionally-known reactive force generation device, no consideration is made at all of a complicated stroke movement where the movement for applying a depressing force to the dome section is made about a plurality of pivot axis or about a single pivot axis moving in position.

SUMMARY OF THE INVENTION

In view of the foregoing prior art problems, it is an object of the present invention to provide an improved reactive force generation device which can not only stabilize an intensity and generation timing of a reactive force generated thereby but also enhance its durability.

In order to accomplish the above-mentioned object, the present invention provides an improved reactive force generation device, which comprises a depression member (20) including a base section (21), and a dome section (22) formed of an elastic material and protruding from the base section (21). A sectional shape of the dome section (22) orthogonal to an axis line (X2) of the dome section is substantially line-symmetric about a symmetry axis (Ax), and the dome section (22) has a three-dimensional shape that is substantially symmetric with respect to a virtual plane (Sx) containing the symmetry axis (Ax) and the axis line (X2). The reactive force generation device of the invention also comprises an opposed member (10) having an opposed surface (11) opposed to the distal end (23) of the dome section (22), and the opposed member (10) in a non-operated state is located remote from the to-be-depressed member (20). At least one of the opposed member (10) and the to-be-depressed member (20) is constructed to make a swinging movement in response to a depressing operation applied thereto, and the opposed member (10) relatively approaches the base section (21) in response to the depressing operation. The dome section (22) elastically deforms by contact between the opposed surface (11) and the distal end (23) during the relative approaching, and such relative approaching of the opposed surface (11) is stopped in a depression-completed state corresponding to a maximum movable range of the opposed member (10) relative to the base section (21). The virtual plane is defined so as not to vary throughout an entire depression stroke from an initial state, where no depressing operation is applied yet, to the depression-completed state. The to-be-depressed member (20) and the opposed member (10) are constructed in such a manner that, as for a variation amount of an angle of the axis line (X2) relative to a normal line (X1) of the opposed surface (11) during the depression stroke, an acute-side angle ($\theta 0$) defined between the axis line (X2) and the normal line (X1) of the opposed surface (11) in the initial state falls in an angle range from a first variation amount ($\Delta\theta A$) of the angle of the axis line (X2) relative to the normal line (X1) during a transition from the initial state to a state where the distal end (23) of the dome section (22) starts contacting the opposed surface (11) to a second angle variation amount ($\Delta\theta A+\Delta\theta B$) of the angle of the axis line (X2) relative to the normal line (X1) during a transition from the initial state to the depression-completed state. The first variation amount ($\Delta\theta A$) of the angle of the axis line (X2) relative to the normal line (X1) is greater than zero degree.

With such arrangements, the reactive force generation device of the present invention can not only stabilize an intensity and generation timing of a reactive force generated thereby but also enhance its durability.

The following will describe embodiments of the present invention, but it should be appreciated that the present invention is not limited to the described embodiments and various modifications of the invention are possible without departing from the basic principles of the invention. The scope of the present invention is therefore to be determined solely by the appended claims.

BRIEF DESCRIPTION OF THE DRAWINGS

Certain preferred embodiments of the present invention will hereinafter be described in detail by way of example only, with reference to the accompanying drawings, in which.

DETAILED DESCRIPTION

First Embodiment

Figure 1A:
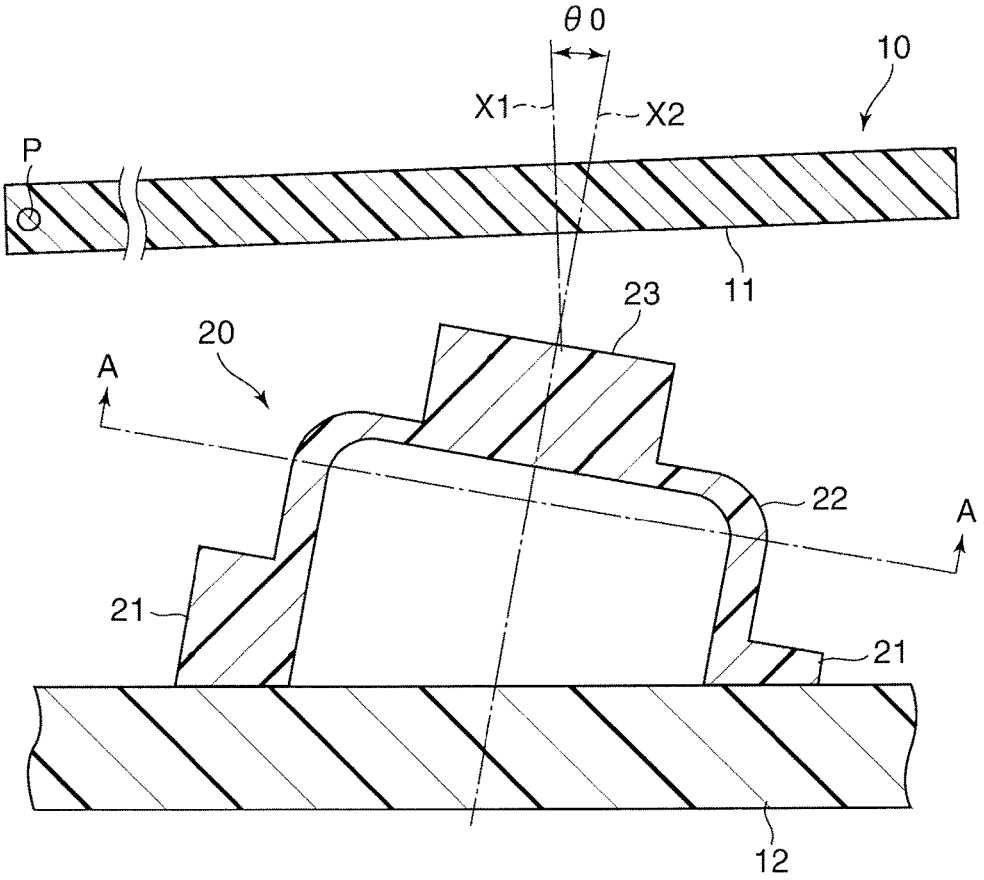
FIG. 1A is a schematic sectional view showing a construction of a reactive force generation device according to a first embodiment of the present invention.

FIG. 1A is a schematic sectional view showing a construction of a reactive force generation device according to a first embodiment of the present invention. This reactive force generation device includes at least a first member 10 and a to-be-depressed member 20 depressible by the first member 10 (i.e., an opposed member 10). The to-be-depressed member 20 is disposed on a second member 12. As an example, the first member 10 is pivotable, or displaceable while making a swaying or swinging movement, within a given angle range about a pivot shaft (or swing shaft) P. Namely, the first member 10 is capable of making stroke movements by pivoting or swinging about the pivot shaft (or swing shaft) P. The first member 10 may itself be a part of a manual operator (not shown) operable by a user, or may be a displacement member that is provided separately from the manual operator but displaceable in interlocked relation to a user's operation of the not-shown manual operator. The second member 12 is, for example, a non-displaceable member, although it may be constructed to relatively pivotally depress the to-be-depressed member 20 in conjunction with the first member 10 in response to displacement of at least one of the first and second members 10 and 12. FIG. 1A shows a non-operated state of the manual operator. When the manual operator is in this non-operated state, the first member 10 is in a free state where it has not yet started its displacement, and the to-be-depressed member 20 is in an initial state where no depressing load is applied yet to the to-be-depressed member 20.

Figure 1B:
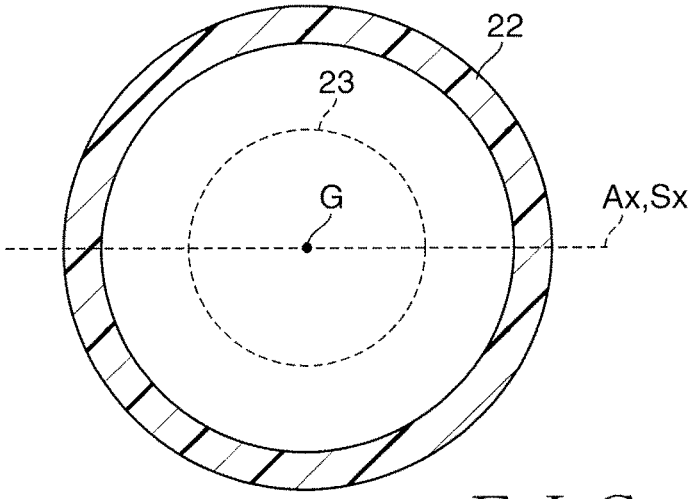
FIG. 1B is a sectional view taken along the A-A line of FIG. 1A.

FIG. 1B is a sectional view taken along the A-A line of FIG. 1A. The to-be-depressed member 20 includes a base section (namely, a base) 21 and a dome section (namely, a dome-shaped section or a dome) 22 and is formed integrally of an elastic material. Note that at least the dome section 22 may be formed integrally of an elastic material. The base section 21 is secured to the dome section 22, and the dome section 22 protrudes from the base section 21. The dome section 22 elastically deforms by the distal end 23 of the dome section 22 being depressed by the first member 10, and an appropriate reactive force to the manual operator is generated by the dome section 22 elastically deforming in such a direction that the distal end 23 relatively approaches the second member 12. As an example, the distal end 23 has a generally circular, flat end surface. The first member 10 has a surface 11 opposed to the distal end 23 of the dome section 22, and the surface 11 will hereinafter be referred to as "opposed surface 11".

In the illustrated example, the dome section 22 protrudes in a direction slightly oblique to the normal line of the second member 12, although it may protrude in the normal line direction of the second member 12. Thus, the direction in which the dome section 22 protrudes generally coincides with an axis line X2 of the dome section 22. More specifically, the axis line X2 is a straight line passing through the centroid G of the distal end 23, and at a plurality of positions within a predetermined length range of the straight line, the dome section 22 has similar sectional shapes along a plane orthogonal to the axis line X2. Further, the sectional shapes of the dome section 22 orthogonal to the axis line X2 are each substantially line-symmetric; in the illustrated example, the sectional shapes of the dome section 22 orthogonal to the axis line X2 are each a circular shape (circular annular shape). Here, a virtual plane containing an axis Ax of the line symmetry (symmetry axis Ax) and the axis line X2 is represented by Sx. The dome section 22 has a three-dimensional shape that is substantially symmetric with respect to the virtual plane Sx. Although any one of various planes is selectable as the plane containing the symmetry axis Ax and the axis line X2, let it be assumed here that a plane always parallel to the normal line X1 of the opposed surface 11 of the first member 10 throughout the entire forward and backward stroke movements of the first member 10 is defined (selected) as the virtual plane Sx. For example, a vertical section of the dome section 22 is shown in FIG. 1A along the virtual plane Sx.

Here, an acute-side angle defined between the axis line X2 and the normal line X1 of the opposed surface 11 (i.e., an angle of the axis line X2 relative to the normal line X1) is represented by $\theta$. In the non-operated state (namely, the initial state) shown in FIG. 1A, the angle $\theta$ is $\theta 0$. A stroke in which the first member 10 and the base section 21 (or the second member 12) relatively approach each other is a depression stroke (i.e., forward-moving stroke). Because the movement where the first member 10 and the base section 21 (or the second member 12) relatively approach each other is a pivotal movement, the angle $\theta$ defined by the first member 10 and the base section 21 will vary during the depression stroke (i.e., forward-moving stroke). Although not particularly shown, a displacement end position of the first member 10 is defined by the manual operator, the first member 10, or another member provided between the manual operator and the first member 10, contacting a stopper or the like. By the first member 10 being stopped at the displacement end position thus defined, the to-be-depressed member is brought to a depression-completed state. Therefore, the depression stroke can be said to be a stroke where, in response to displacement of the manual operator from the non-operated state, the to-be-depressed member 20 transitions from the initial state to the depression-completed state that corresponds to a maximum movable range of the to-be-depressed member 20 relative to the opposed surface 11. Once the depressing force imparted to the first member 10 is removed, the first member 10 returns to its initial state (non-operated state) by the action of a not-shown urging member (such as a spring), and the to-be-depressed member 20 returns to its initial state by its own elasticity. Here, the virtual plane Sx is defined so as not to vary throughout the entire depression stroke (forward-moving stroke), although the dome section 20 deforms during the depression stroke. Thus, the virtual plane Sx is always substantially parallel to the normal line X1.

Figure 2A:
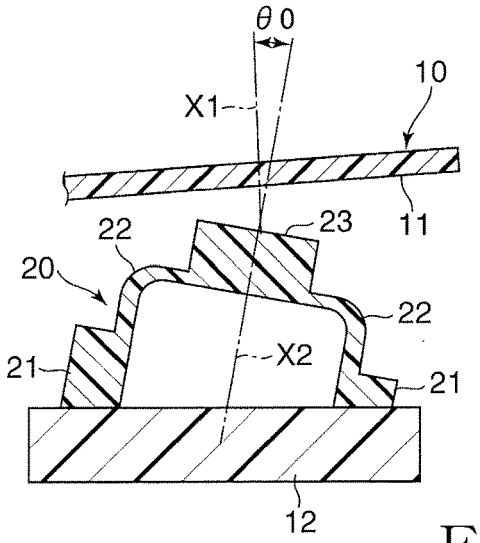
FIGS. 2A to 2C are diagrams showing a state transition of a depression member during a depression stroke in the first embodiment of the reactive force generation device.
Figure 2B:
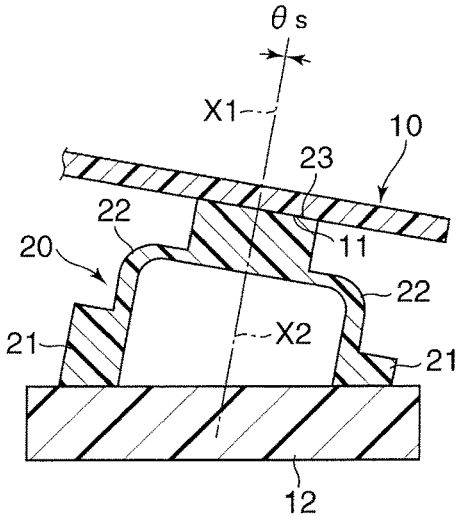
Figure 2C:
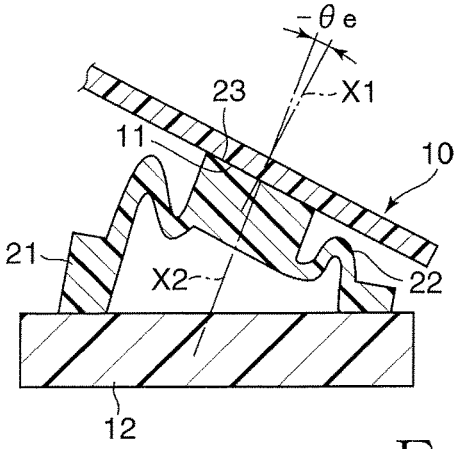

FIGS. 2A, 2B and 2C are diagrams showing a state transition of the to-be-depressed member 20 during the depression stroke. More specifically, FIG. 2A shows the to-be-depressed member 20 in the non-operated state (initial state), FIG. 2B shows the to-be-depressed member 20 at a time point when the first member 10 and the distal end 23 of the dome section 22 start contacting each other, and FIG. 2C shows the to-be-depressed member 20 in the depression-completed state. More specifically, here, the angle θ defined between the axis line X2 and the normal line X1 is considered on the virtual plane Sx, the angle θ in the non-operated state is expressed as a positive angle, and the angle θ after positional relationship between the axis line X2 and the normal line X1 is reversed, e.g. the angle θ in the depression-completed state, is expressed as a negative angle. In the non-operated state of FIG. 2A, the angle θ is θ0 (e.g., +20°). The angle θ becomes θs (e.g., 0°) at the time point when the first member 10 and the distal end 23 of the dome section 22 start contacting each other as shown in FIG. 2B. Further, in the depression-completed state of FIG. 2C, the angle θ becomes −θe (e.g., −10°).

The angle θ defined between the axis line X2 and the normal line X1 varies during the depression stroke V as follows. A variation amount ΔθA of the angle θ from the non-operated state to the state where the distal end 23 starts contacting the opposed surface 11 (i.e., angle variation amount ΔθA till the to-be-depressed member 20 transitions to the state of FIG. 2B from the state of FIG. 2A) can be expressed as "ΔθA=θ0−θs" and is, for example, about 20°. Such a variation amount ΔθA of the angle θ will hereinafter be referred to as "first angle variation amount" or "first variation amount". A variation amount ΔθB of the angle θ till the to-be-depressed member 20 transitions to the depression-completed state after the distal end 23 contacts the opposed surface 11 (i.e., angle variation amount ΔθB till the to-be-depressed member 20 transitions from the state of FIG. 2B to the state of FIG. 2C) can be expressed as "ΔθB=θs−(−θe)" and is, for example, about 10°. Therefore, a "second angle variation amount" (or a "second variation amount of the angle θ") during a transition from the non-operated state to the depression-completed state can be expressed as "ΔθA+ΔθB" and is, for example, about 30°.

The instant embodiment of the invention is constructed to satisfy a predetermined condition that the angle θ (θ0) in the non-operated state (initial state) falls in the angle range from the first angle variation amount (ΔθA) to the second angle variation amount (ΔθA+ΔθB) (respective values of the first and second angle variation amounts may be included in the angle range). Namely, the instant embodiment is based on the condition of "ΔθA≤θ0≤(ΔθA+ΔθB)". Let it be also assumed here that the first angle variation amount ΔθA is greater than 0° (zero degree). Because θ0 is about 20° (20 degree) in the example shown in FIGS. 2A to 2C, the instant embodiment is designed so that the angle θ becomes just 0° at the time point when the first member 10 and the distal end 23 of the dome section 22 starts contacting each other as shown in FIG. 2B. Namely, the axis line X2 intersects the opposed surface 11 substantially perpendicularly when the distal end 23 has started contacting the opposed surface 11 in the depression stroke. However, the present invention is not necessarily so limited. Assuming, for example, that the angle θ0 is 25° in the design where the first angle variation amount is 20° and the second angle variation amount is 30°, the axis line X2 intersects the opposed surface 11 perpendicularly in a time period before the to-be-depressed member 20 transitions to the depression-completed state after the distal end 23 contacts the opposed surface 11 in the depression stroke. Further, according to the aforementioned condition, the reactive force generation device may be alternatively constructed in such a manner that the axis line X2 intersects the opposed surface 11 perpendicularly at the time point when the to-be-depressed member 20 has transitioned to the depression-completed state.

The aforementioned inequality expression "ΔθA≤θ0≤ΔθB" can be rewritten, using the angles θs and θe, into "(θ0−θs)≤θ0≤(θ0+θe)". If θ0 is subtracted from each of the terms, "(θ0−θs)≤θ0≤(θ0+θe)" can be expressed equivalently as "−θs≤0≤θe". As apparent from this inequality expression, the state where the angle θ becomes 0° occurs in the period before the to-be-depressed member 20 transitions to the depression-completed state after the distal end 23 contacts the opposed surface 11 in the depression stroke. Thus, in the instant embodiment, the contacting (landing) action between the distal end 23 and the opposed surface 11 can be significantly stabilized, as compared to the construction where the axis line X2 constantly inclines relative to the normal line X1 in one particular direction until the to-be-depressed member 20 transitions to the depression-completed state after the distal end 23 contacts the opposed surface 11. The timing at which the angle θ becomes 0° affects the generation timing and form of the reactive force. In this way, the instant embodiment can not only stabilize the intensity and generation timing of the reactive force but also achieve an enhanced durability of the reactive force generation device.

Figure 3A:
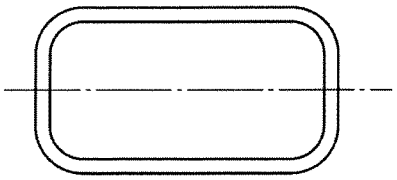
FIGS. 3A to 3E are views showing some modifications of a sectional shape of a dome section in the first embodiment of the reactive force generation device.
Figure 3B:
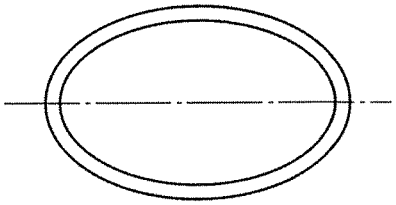
Figure 3C:
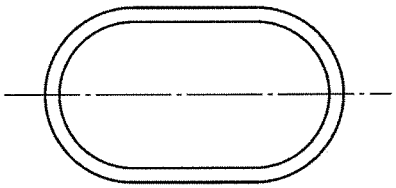
Figure 3D:
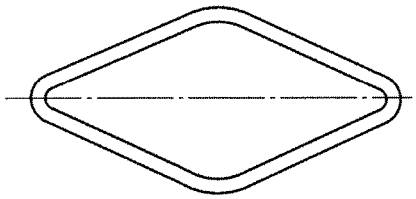
Figure 3E:
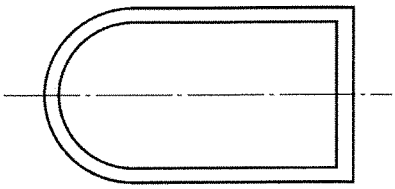

In the instant embodiment, the sectional shape of the dome section 22 orthogonal to the axis line X2 is a circular shape as noted above. However, it just suffices that the sectional shape of the dome section 22 orthogonal to the axis line X2 is line-symmetric, as illustratively shown in FIGS. 3A to 3E. Namely, the sectional shape of the dome section 22 orthogonal to the axis line X2 may be any one of a rectangular shape with rounded corners (FIG. 3A), an elliptical shape (FIG. 3B), an annular shape with straight line portions (FIG. 3C), a rhombic or diamond shape with rounded corners (FIG. 3D) and another shape with straight line portions and a semicircular portion (FIG. 3E).

The distal end 23 of the dome section 22 and the opposed surface 11 come to lie substantially parallel to each other at the time point when the distal end 23 and the opposed surface 11 start contacting each other. However, the present invention is not necessarily so limited, and the distal end 23 may have an inclination relative to the opposed surface 11 at the time point when the distal end 23 and the opposed surface 11 start contacting each other. Further, whereas the distal end 23 of the dome section 22 has been described above as being flat, the present invention is not necessarily so limited. For example, the distal end 23 may have a convexly protruding shape with some roundness or a protruding shape with its top portion having an obtuse or acute angle. In the case where the distal end 23 is not flat like this, the centroid G of the dome section 22 can be identified on the basis of a projection geometry of the distal end 23 in the protruding direction.

Second Embodiment

Figure 4A:
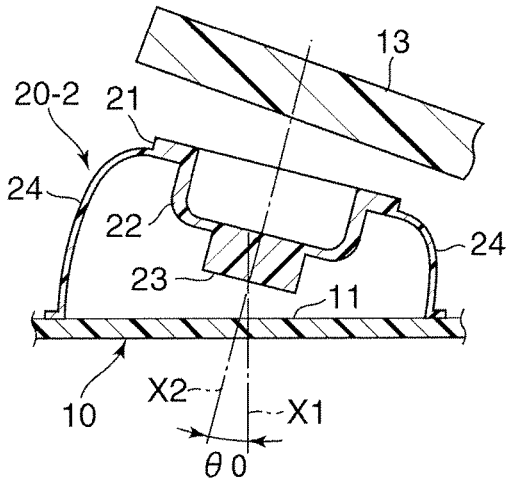
FIGS. 4A to 4D are schematic sectional views showing a construction of a reactive force generation device according to a second embodiment of the present invention, which particularly shows a state transition of the depression member during the depression stroke in the second embodiment of the reactive force generation device.
Figure 4B:
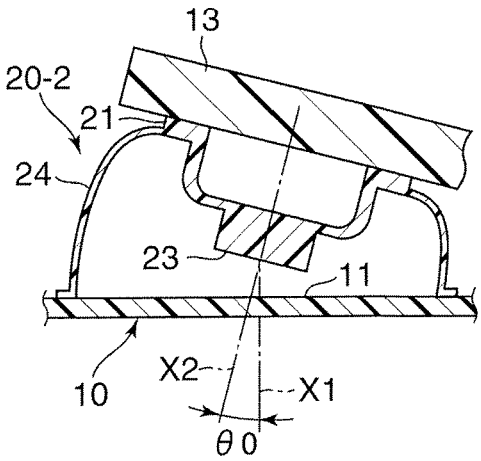
Figure 4C:
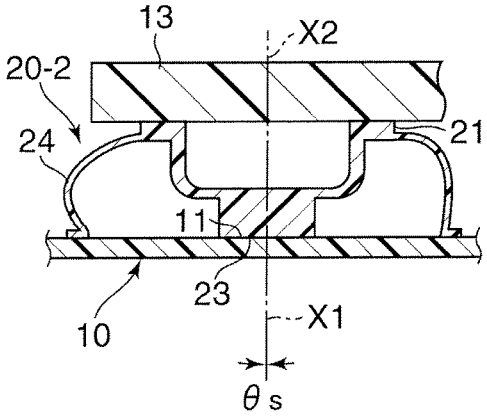
Figure 4D:
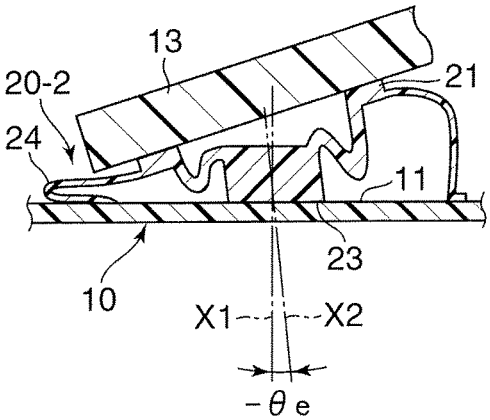

The following describe a reactive force generation device according to a second embodiment of the present invention, which is characterized by a construction for causing a depressing member 13 to depress the base section 21. FIGS. 4A, to 4D are diagrams showing a state transition of the to-be-depressed member 20-2 during the depression stroke in the second embodiment. The to-be-depressed member 20-2 is generally similar to the to-be-depressed member 20 described above in relation to the first embodiment, except that it includes a skirt section 24 having elasticity. In the illustrated example, the base section 21 is held on the first member 10 via the elastic skirt section 24. The base section 21 and the dome section 22 (having the distal end 23) are substantially similar in construction to those of the to-be-depressed member 20 shown in FIG. 1A. Note that the skirt section 24 is deformable sufficiently more easily than the dome section 22 and hence does not greatly contribute to the reactive force generation.

As an example, the depressing member 13 is pivotable, or displaceable while making a swinging movement, about a not-shown pivot shaft. The depressing member 13 may be either the manual operator itself or a displacement member displaceable by a user's operation of the manual operator. The first member 10 in the illustrated example is a non-displaceable member, but the present invention is not necessarily so limited; for example, the to-be-depressed member 20-2 may be depressed by cooperation between the first member 10 and the depressing member 13 by at least one of the first member 10 and the depressing member 13 being displaced. The base section 21 is subjected to a depressing force given from the depressing member 13. FIG. 4A shows the to-be-depressed member 20-2 in a non-operated state (initial state), FIG. 4B shows the to-be-depressed member 20-2 at a time point when the base section 21 and the depressing member 13 start contacting each other, FIG. 4C shows the to-be-depressed member 20-2 at a time point when the first member 10 and the distal end 23 start contacting each other, and FIG. 4D shows the to-be-depressed member 20-2 in a depression-completed state. Similarly to the above-described first embodiment, the second embodiment is constructed in such a manner that a displacement end position of the depressing member 13 is defined by the depressing member 13, or another member provided between the manual operator and the depressing member 13, contacting a stopper or the like. The to-be-depressed member 20-2 is brought to the depression-completed state by the depressing member 13 being stopped at the thus-defined displacement end position. Then, once the depressing force imparted by the depressing member 13 is removed, the depressing member 13 returns to its initial state (non-operated state) by the action of a not-shown urging member (such as a spring), and the to-be-depressed member 20-2 returns to its initial state by its own elasticity, in the same manner as in the above-described first embodiment.

Except for the elastic deformation of the skirt section 24, the transition of the variation amount $\Delta\theta$ of the angle $\theta$ during the depression stroke in the second embodiment is fundamentally similar to that in the above-described first embodiment. The angle $\theta$, which is $\theta$0 in the non-operated state of FIG. 4A, becomes $\theta$s at the time point when the first member 10 and the distal end 23 start contacting each other as shown in FIG. 4C, and becomes "$-\theta$e" in the depression-completed state of FIG. 4D. The instant embodiment is designed in such a manner that the angle $\theta$ (namely, $\theta$0) in the non-operated state falls in the angle range from the first angle variation amount $\Delta\theta$A to the second angle variation amount $\Delta\theta$B (respective values of the first and second angle variation amounts may be included in the angle range).

Similarly to the first embodiment, the above-described second embodiment can not only stabilize the intensity and generation timing of the reactive force but also achieve an enhanced durability of the reactive force generation device.

Note that the second embodiment may be constructed in such a manner that the base section 21 and the depressing member 13 are held in advance in contact (that may be light pressing contact) with each other when the manual operator is in the non-operated state. In such a case, the non-operated state where the base section 21 and the depressing member 13 are held in advance in contact with each other as above corresponds to the initial state of the to-be-depressed member 20-2.

Third Embodiment

Figure 5:
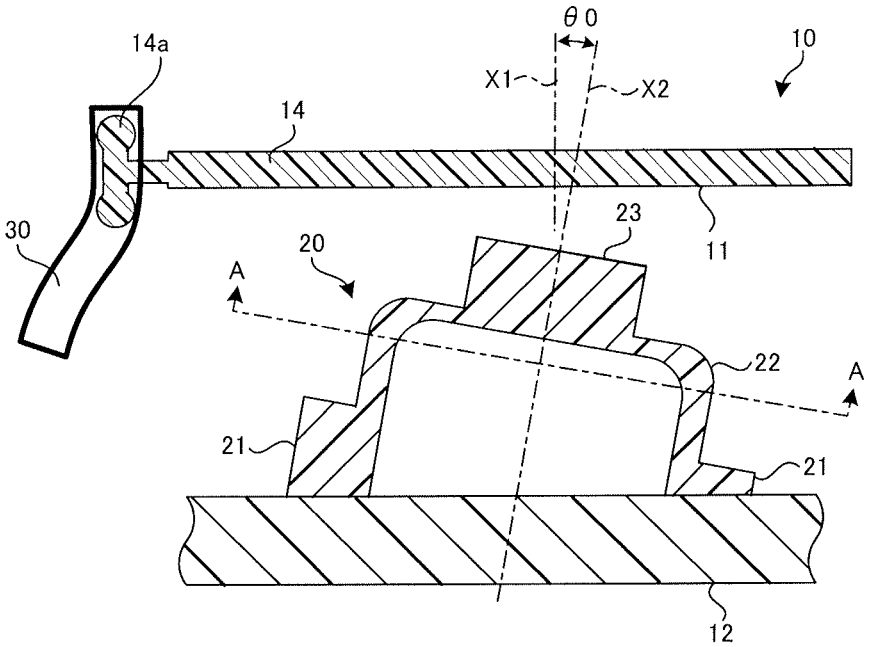
FIG. 5 is a schematic sectional view showing a construction of a reactive force generation device according to a third embodiment of the present invention.

In the above-described first and second embodiments of the present invention, the first member 10 or the depressing member 13 is constructed to make a pivotal or swinging movement about one fixed pivot shaft P. However, the present invention is not necessarily so limited, and the basic principles of the present invention are also applicable to other constructions or designs that make complicated stroke movements, such as one where a swinging movement axis (center of swinging movement) is displaced during the depression stroke. FIG. 5 is a schematic sectional view showing an embodiment of the present invention applied to the construction where the swinging movement axis (or a virtual swinging movement axis) is displaced during the depression stroke. In FIG. 5, elements indicated by the same reference numerals and characters as in FIG. 1A function in substantially the same manner as the corresponding elements described above with reference to FIG. 1A and thus will not be described here to avoid unnecessary duplication.

In the illustrated example of FIG. 5, as in the illustrated example of FIG. 1A, the first member 10 makes a swinging movement in response to a depression operation, but the second member 12 having the to-be-depressed member 20 disposed thereon remains unmoved. Here, the first member 10 comprises a swinging member 14, and the lower surface of the swinging member 14 is constructed to function as the opposed surface 11. One end of the swinging member 14 is provided as a base part 14*a* of a multi-point support structure, and this base part 14*a* is fitted in a guide groove 30 provided in a not-shown frame so that the base part 14 can move while being guided by the guide groove 30. The guide groove 30 is formed in a multifocal curved shape such that an angle defined by the opposed surface 11 of the swinging member 14 relative to the horizontal plane varies as the base part 14*a* moves in and along the guide groove 30. More specifically, FIG. 5 shows an initial state (non-operated state) of the first member 10, i.e. the swinging member 14. When a depressing operation (force) is applied to the first member 10 in the initial state, the swinging member 14 moves downward along the curved guide groove 30, during which time the angle defined by the opposed surface 11 of the swinging member 14 relative to the horizontal plane varies in accordance with the curved shape of the guide groove 30. By such structural arrangements, the swinging movement of the first member 10, i.e. the swinging member 14, becomes a complicated one where the center point of the swinging movement is displaced, rather than one where the member 10 pivots about a single fixed center point. The basic principles of the present invention are applicable to the reactive force generation device having the swinging construction as shown in FIG. 5, as well as to the first embodiment described above with reference to FIGS. 1A to 2C. Thus, the present invention can provide an advantageous construction which can not only stabilize the intensity and generation timing of the reactive force but also achieve an enhanced durability of the reactive force generation device in the case where the swinging movement of the first member 10, i.e. the swinging member 14, presents such a complicated stroke movement where the axis (center point) of the swinging movement is displaced.

Furthermore, the combination of the base part 14*a* of a multi-point support structure and the guide groove 30 as shown in FIG. 5 is also applicable to the construction having the depressing member 13 as shown in FIGS. 4A to 4D.

Note that the reactive force generation device of the present invention may be applied to keyboard apparatus and keyboard musical instruments. In the case where the reactive force generation device of the present invention is applied to a keyboard apparatus, a plurality of the reactive force generation devices of the present invention are provided in the keyboard apparatus which has a plurality of keys operable by a user, each of the plurality of the reactive force generation devices is provided in corresponding relation to any one of the plurality of keys so that each key functions as the aforementioned manual operator and that the depressing operation is applied to at least one of the first member (opposed member) 10 and the to-be-depressed member 20 of the reactive force generation device via the corresponding key. Further, in the case where the reactive force generation device of the present invention is applied to a keyboard musical instrument, the first member 10 or the depressing member 13 may either be a key of the keyboard or another member of the keyboard displaceable in response to a movement of the key. For example, such a displaceable member may be a hammer that imparts inertia to a key depressing operation.

Also note that the reactive force generation device of the present invention can be used as a switch device for detecting a key depressing operation. In such a case, for example, the first member 10 is constructed as a base plate, a fixed contact is provided on the opposed surface 11 and a movable contact is provided on the distal end 23 of the dome section 22, so that a key depressing operation can be detected by contact between the fixed contact and the movable contact.

Also note that the number of the dome section 22 to be depressed by a single member may be any desired number other than one. For example, the second embodiment may be modified so that a plurality of the dome sections 22 are provided to protrude from the base section 21 into a space surrounded by the skirt section 24 and that the distal ends of these dome section 22 contact the opposed surface 11 at their respective timing. In other words, in an embodiment of the reactive force generation device according to the present invention, in addition to the aforementioned single dome section 22, one or more additional dome protrusions formed of an elastic material can be provided on the to-be-depressed member 20.

In the case where the reactive force generation device of the present invention is applied to a keyboard apparatus, and if the stopper is formed of a soft material, the depressing member 13 moves slightly by inertia, without stopping immediately, even when the depressing member 13, or another member provided between the manual operator and the depressing member 13, contacts the stopper or the like. Because such arrangements can stabilize the reactive force generated until the depressing member 13 and the to-be-depressed member 20-2 actually stop after the depressing member 13 or the other member contacts the stopper, an appropriate initial returning speed can be imparted to the depressing member 13, which can also advantageously achieve an enhanced successive hitting capability of the manual operator. Respective reactive forces of the dome section 22, skirt section 24 and stopper can contribute to the impartment of the initial returning speed to the depressing member 13 (or the manual operator) and hence to the enhancement of the successive hitting capability. By stabilizing the reactive forces generated by the dome section 22 and skirt section 24 of the respective reactive forces of the dome section 22, skirt section 24 and stopper, a stable initial returning speed can be generated and imparted to the depressing member 13 (or the manual operator). Thus, the depressing member 13 can return quickly to allow a next key depressing operation to be performed immediately, which can lead to an enhanced successive hitting capability. Note that, in the case where a plurality of the dome sections 22 are provided and each of the dome sections 22 is equipped with the switching function, the reactive force generation device of the invention is constructed, for the enhancement of the successive hitting capability, in such a manner that the depressing member 13 can return, by the imparted initial returning speed, at least to the OFF position of the switch that is disposed to be turned on last in the forward-moving stroke.

Whereas the present invention has been described above in detail on the basis of various preferred embodiments of the invention, it should be appreciated that the present invention is not necessarily limited to the above-described embodiments and may be modified variously without departing from the gist of the present invention. Portions of the embodiments of the present invention may be combined as appropriate.

This application is based on, and claims priority to, Japanese Patent Application No. 2017-074723 filed on 4 Apr. 2017. The disclosure of the priority application, in its entirety, including the drawings, claims, and the specification thereof, are incorporated herein by reference.

What is claimed is:

1. A reactive force generation device comprising:

a to-be-depressed member including a base section, and a dome section formed of an elastic material and protruding from the base section, a sectional shape of the dome section orthogonal to an axis line of the dome section being substantially line-symmetric about a symmetry axis, the dome section having a three-dimensional shape that is substantially symmetric with respect to a virtual plane containing the symmetry axis and the axis line; and an opposed member having an opposed surface opposed to a distal end of the dome section, the opposed member in a non-operated state being located remote from the to-be-depressed member, at least one of the opposed member and the to-be-depressed member being constructed to make a swinging movement in response to a depressing operation applied thereto, wherein the opposed member relatively approaches the base section in response to the depressing operation, the dome section deforms by contact between the opposed surface and the distal end during the relative approaching, and the relative approaching is stopped in a depression-completed state corresponding to a maximum movable range of the opposed member relative to the base section, the virtual plane being defined so as not to vary throughout an entire depression stroke from an initial state, where no depressing operation is applied yet, to the depression-completed state, the to-be-depressed member and the opposed member being constructed in such a manner that, as for a variation amount of an angle of the axis line relative to a normal line of the opposed surface during the depression stroke, an acute-side angle defined between the axis line and the normal line of the opposed surface in the initial state falls in an angle range from a first variation amount of the angle of the axis line relative to the normal line during a transition from the initial state to a state where the distal end of the dome section starts contacting the opposed surface to a second variation amount of the angle of the axis line relative to the normal line during a transition from the initial state to the depression-completed state, the first variation amount of the angle of the axis line relative to the normal line being greater than zero degree.

2. The reactive force generation device as claimed in claim 1, wherein the axis line intersects the opposed surface substantially perpendicularly when the distal end of the dome section starts contacting the opposed surface.

3. The reactive force generation device as claimed in claim 1, wherein in the depression stroke, the axis line intersects the opposed surface perpendicularly in a period before the transition to the depression-completed state occurs after the distal end of the dome section contacts the opposed surface.

4. The reactive force generation device as claimed in claim 1, wherein the axis line is a straight line passing through a centroid of a distal end surface of the dome section, and wherein at a plurality of positions within a predetermined length range of the straight line, the dome section has similar sectional shapes along a plane orthogonal to the axis line.

5. The reactive force generation device as claimed in claim 1, wherein the depressing operation is applied to the opposed member via a manual operator.

6. The reactive force generation device as claimed in claim 1, wherein the depressing operation is applied to the to-be-depressed member via a manual operator.

7. The reactive force generation device as claimed in claim 1, wherein said at least one of the opposed member and the to-be-depressed member is constructed to make the swinging movement in response to the depressing operation applied thereto in such a manner that a swinging movement axis is displaced during the depression stroke.

8. The reactive force generation device as claimed in claim 1, wherein the depressing operation is applied to the at least one of the opposed member and the to-be-depressed member via a manual operator operable by a user, and the reactive force generation device further comprises a stopper, formed of a soft material, for stopping a movement based on the depressing operation via the manual operator.

9. The reactive force generation device as claimed in claim 1, wherein the to-be-depressed member further includes one or more additional dome protrusions formed of an elastic material and protruding from the base section.

10. The reactive force generation device as claimed in claim 1, which further comprises a switch device configured to detect the depressing operation.

11. The reactive force generation device as claimed in claim 10, wherein the switch device is configured to detect the depressing operation based on contact between the opposed surface of the opposed member and the distal end of the dome section.

12. The reactive force generation device as claimed in claim 1, wherein a plurality of the reactive force generation devices are provided in a keyboard apparatus having a plurality of keys operable by a user, each of the plurality of the reactive force generation devices being provided in corresponding relation to any one of the plurality of keys so that the depressing operation is applied to at least one of the opposed member and the to-be-depressed member of the reactive force generation device via the corresponding key.

13. The reactive force generation device as claimed in claim 12, wherein the keyboard apparatus is a keyboard musical instrument.

14. A keyboard apparatus comprising:

a plurality of keys operable by a user; and a plurality of reactive force generation devices, each provided in corresponding relation to any one of the plurality of keys, each of the plurality of reactive force generation devices comprising:

a to-be-depressed member including a base section, and a dome section formed of an elastic material and protruding from the base section, a sectional shape of the dome section orthogonal to an axis line of the dome section being substantially line-symmetric about a symmetry axis, the dome section having a three-dimensional shape that is substantially symmetric with respect to a virtual plane containing the symmetry axis and the axis line; and an opposed member having an opposed surface opposed to a distal end of the dome section, the opposed member in a non-operated state being located remote from the to-be-depressed member, at least one of the opposed member and the to-be-depressed member being constructed to make a swinging movement in response to a depressing operation applied thereto via the corresponding key, wherein the opposed member relatively approaches the base section in response to the depressing operation, the dome section deforms by contact between the opposed surface and the distal end during the relative approaching, and the relative approaching is stopped in a depression-completed state corresponding to a maximum movable range of the opposed member relative to the base section, the virtual plane being defined so as not to vary throughout an entire depression stroke from an initial state, where no depressing operation is applied yet, to the depression-completed state, the to-be-depressed member and the opposed member being constructed in such a manner that, as for a variation amount of an angle of the axis line relative to a normal line of the opposed surface during the depression stroke, an acute-side angle defined between the axis line and the normal line of the opposed surface in the initial state falls in an angle range from a first variation amount of the angle of the axis line relative to the normal line during a transition from the initial state to a state where the distal end of the dome section starts contacting the opposed surface to a second variation amount of the angle of the axis line relative to the normal line during a transition from the initial state to the depression-completed state, the first variation amount of the angle of the axis line relative to the normal line being greater than zero degree.

* * * * *